US010323809B1

(12) United States Patent
Dai

(10) Patent No.: US 10,323,809 B1
(45) Date of Patent: Jun. 18, 2019

(54) GARDEN LIGHT WITH FLAME EFFECT

(71) Applicant: Ningbo Weitao Electrical Appliance Co., Ltd., Ningbo, Zhejiang (CN)

(72) Inventor: Jiangang Dai, Zhejiang (CN)

(73) Assignee: Ningbo Weitao Electrical Appliance Co., Ltd., Ningbo (CN)

( * ) Notice: Subject to any disclaimer, the term of this patent is extended or adjusted under 35 U.S.C. 154(b) by 0 days.

(21) Appl. No.: 16/021,706

(22) Filed: Jun. 28, 2018

(30) Foreign Application Priority Data

May 15, 2018 (CN) ..... 2018 2 0722485 U

(51) Int. Cl.

| | |
|---|---|
| ***F21S 8/00*** | (2006.01) |
| ***F21S 10/04*** | (2006.01) |
| ***F21K 9/66*** | (2016.01) |
| *F21W 131/109* | (2006.01) |
| *F21Y 115/10* | (2016.01) |
| *F21V 21/08* | (2006.01) |

(52) U.S. Cl.
CPC ..... *F21S 10/04* (2013.01); *F21K 9/66* (2016.08); *F21S 8/036* (2013.01); *F21V 21/0824* (2013.01); *F21W 2131/109* (2013.01); *F21Y 2115/10* (2016.08)

(58) Field of Classification Search
CPC ..... F21V 21/0824; F21S 10/04; F21K 9/66
See application file for complete search history.

(56) References Cited

U.S. PATENT DOCUMENTS

| | | | | |
|---|---|---|---|---|
| 6,580,228 | B1 * | 6/2003 | Chen | F21K 9/90 315/185 R |
| 6,846,094 | B2 * | 1/2005 | Luk | H05B 33/0857 362/240 |
| 7,219,456 | B1 * | 5/2007 | Wei | F24C 7/004 392/348 |
| 7,938,562 | B2 * | 5/2011 | Ivey | F21V 33/0052 362/276 |
| 2014/0369038 | A1 * | 12/2014 | Tischler | F21V 21/14 362/235 |

* cited by examiner

*Primary Examiner* — Anabel Ton

(57) ABSTRACT

A garden light with flame effect includes a light body, and a mounting pole sharpened on the lower end or a mounting board. The light body is mounted by the mounting pole or the mounting board. The light body includes a PCB, a base body mounted with a plurality of SMD LED lights, a lampshade, and a hollow case. The base body has a cylindrical structure. The plurality of SMD LED lights are distributed on an outer peripheral surface of the base body and connected to the PCB. The lower end of the base body is fully covered with the SMD LED lights while the SMD LED lights on the upper end of the base body have a wave-shaped distribution. The lampshade has a cylindrical structure encasing the base body. The hollow case encases the lampshade. The garden light is simple in structure, aesthetic and convenient to use.

6 Claims, 3 Drawing Sheets

GARDEN LIGHT WITH FLAME EFFECT

CROSS-REFERENCE OF RELATED APPLICATIONS

The present application claims priority of Chinese Patent Application No. 201820722485.9 filed on May 15, 2018, the entirety of which is incorporated herein by reference.

FIELD OF TECHNOLOGY

The present application relates to the field of lighting technology, in particular to a garden light with flame effect.

BACKGROUND TECHNOLOGY

With the development of the social economy, the development of cities is getting faster and faster. For the convenience of people's lives, lighting equipments are provided in urban communities and parks. Garden lights are the main lighting equipment and are widely used in communities and various crowded park avenues. Garden lights light for people at night and are deeply loved by people. Garden lights are widely used, people have more and more demands for garden lights, and there are more and more researches on garden lights.

LED garden light is a semiconductor light using a light emitting diode as a light source. Since it is a solid cold light source, it has the characteristics of being environmental friendly, no pollution, low power consumption, high luminous efficiency, and long service life. Therefore, common garden lights on the market today are LED garden lights.

However, most of the current researches and breakthroughs are limited to the long-term use and energy conversion of garden lights, and do not take into account that garden lights themselves are part of the urban culture. Therefore, how to design an auxiliary lighting garden light which is simple in structure, aesthetic and convenient to use so as to make up for the deficiency of the monotonous lighting of the current garden lights has become a direction of thinking for designers of the present application.

In view of this, the designer of the present application has conducted in-depth discussions on the foregoing problems, and, with years of experience in R&D and manufacturing of related industries, has been actively seeking solutions. After long-term efforts in research and development, the present application of "garden light with flame effect" has been successfully developed to resolve the problems of the existing technology.

SUMMARY

The technical problem to be solved by the present application is to provide a garden light with flame effect which is simple in structure, aesthetic and convenient to use.

The technical solution adopted by the present application to solve the above technical problems is: a garden light with flame effect, which includes a light body, and a mounting pole sharpened on the lower end or a mounting board. The light body is mounted by the mounting pole or the mounting board. The light body includes a PCB (printed circuit board), a base body mounted with a plurality of SMD (surface-mount device) LED lights, a lampshade, and a hollow case. The base body has a cylindrical structure. The plurality of SMD LED lights are distributed on an outer peripheral surface of the base body and connected to the PCB. The lower end of the base body is fully covered with the SMD LED lights while the SMD LED lights on the upper end of the base body have a wave-shaped distribution. The lampshade has a cylindrical structure encasing the base body. The hollow case encases the lampshade.

A further preferred solution of the present application: the PCB is mounted on the top of the base body; and the upper surface of the light body is provided with a control button connected to the PCB.

A further preferred solution of the present application: first hollow flame-shaped openings are symmetrically provided on the hollow case; and second horizontal strip-shaped hollow openings are provided on both sides of the first hollow openings.

A further preferred solution of the present application: an outer surface of the hollow case is an arc-shaped curved surface.

A further preferred solution of the present application: the light body is located above the mounting pole; a lower portion of the mounting pole is formed by interlacing two strip-shaped structural members; a cross-section of the lower portion of the mounting pole is cross-shaped; and the bottom of the mounting pole is gradually sharpened.

A further preferred solution of the present application: the light body is located above the mounting board; the mounting board comprises a lateral support plate and a vertical support plate that are fixed together; the lateral support plate is fixed under the light body; and the vertical support plate is mountable to a wall.

Compared with the prior art, the advantages of the present application lie on that the light body is mounted by the mounting pole or the mounting board. The structure of the present application is very simple. The present application can be inserted into the ground of gardens using the pole or fixedly connected to the wall body using the mounting board, and the installation is stable and convenient. The light body includes a PCB, a base body mounted with a plurality of SMD LED lights, a lampshade, and a hollow case. The base body has a cylindrical structure. The plurality of SMD LED lights are distributed on an outer peripheral surface of the base body and connected to the PCB. The lower end of the base body is fully covered with the SMD LED lights while the SMD LED lights on the upper end of the base body have a wave-shaped distribution. The lampshade has a cylindrical structure encasing the base body. The hollow case encases the lampshade. The distribution of the plurality of SMD LED lights has simulated the shape of flame, and, by using the PCB to control the on and off of various SMD LED lights, mimics beating of the flame. The light that people observe through the hollow case looks like a torch, which is excellent ornamental.

BRIEF DESCRIPTIONS OF THE DRAWINGS

DETAILED DESCRIPTIONS

The present application will be described in detail below with reference to the accompanying drawings.

In order to make the objectives, technical solutions, and advantages of the present application clearer and more comprehensible, the present application will be further described in detail below with reference to the accompanying drawings and embodiments. It should be understood that the specific embodiments described herein are only used to explain the present application and are not used to limit the present application.

Figure 1:
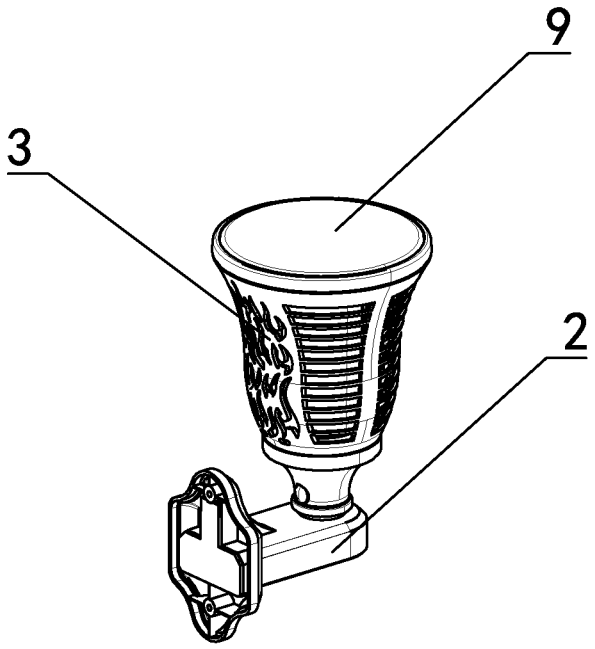
FIG. 1 is a schematic structural view of a first embodiment of the present application.
Figure 3:
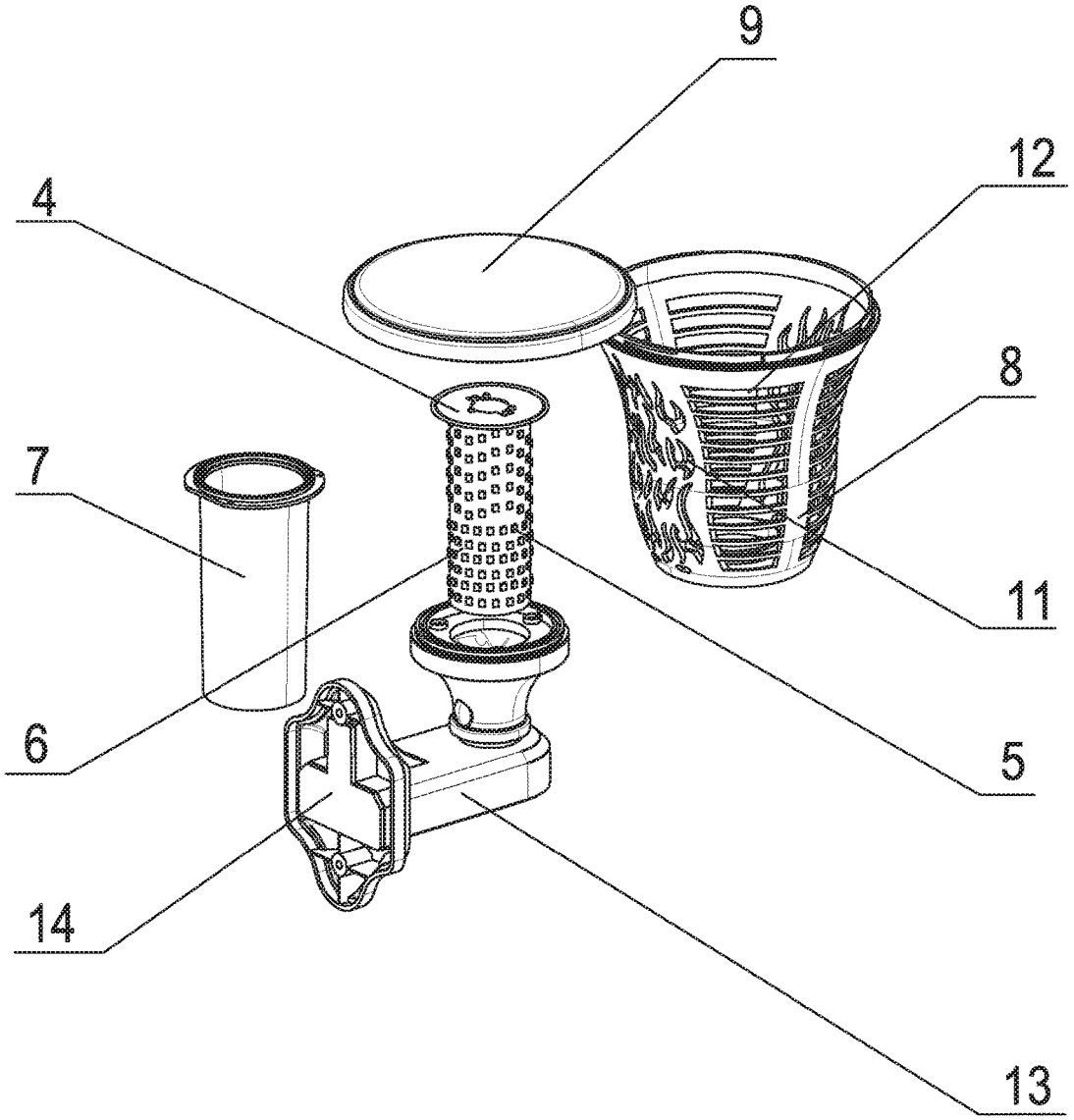
FIG. 3 is a schematic exploded structural view of the present application.

FIGS. 1 and 3 show a first embodiment of the present application: a garden light with flame effect which includes a light body 3 mounted on a mounting pole 1 or a mounting board 2. The light body 3 includes a PCB 4, a base body 6 mounted with a plurality of SMD (surface-mount device) LED lights 5, a lampshade 7, and a hollow case 8. The base body 6 has a cylindrical structure. The plurality of SMD LED lights 5 are distributed on the outer peripheral surface of the base body 6 and connected to the PCB 4. The lower end of the base body 6 is fully covered with the SMD LED lights 5 while the SMD LED lights 5 on the upper end of the base body 6 have a wave-shaped distribution. The lampshade 7 has a cylindrical structure encasing the base body 6. The hollow case 8 encases the lampshade 7.

The PCB 4 is mounted on the top of the base body 6. The upper surface of the light body 3 is provided with a control button 9 connected to the PCB 4. The control button 9 is used to independently control the operating status of the garden light.

First hollow flame-shaped openings 11 are symmetrically provided on the hollow case 8. Second horizontal strip-shaped hollow openings 12 are provided on both sides of the first hollow openings 11. Using the hollow case 8 to encase the flame-shaped light and observing the light illumination inside through the first hollow openings 11 and the second hollow openings 12 thereon is more artistic and aesthetic.

The outer surface of the hollow case 8 is an arc-shaped curved surface.

The light body 3 is located above the mounting board 2. The mounting board 2 includes a lateral support plate 13 and a vertical support plate 14 that are fixed together. The lateral support plate 13 is fixed under the light body 3, and the vertical support plate 14 is mountable to a wall.

Figure 2:
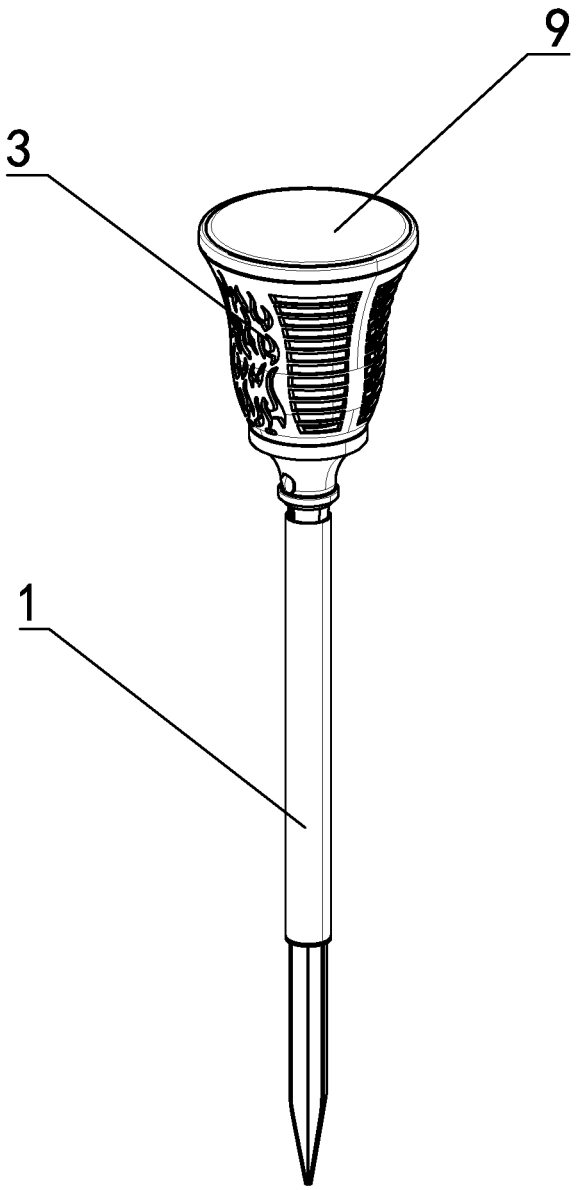
FIG. 2 is a schematic structural view of a second embodiment of the present application.

FIG. 2 shows a second embodiment of the present application, of which the structure is the same as the first embodiment except that: the light body 3 is located above the mounting pole 1; the lower portion of the mounting pole 1 is formed by interlacing two strip-shaped structural members; the cross-section of the lower portion of the mounting pole 1 is cross-shaped; and the bottom of the mounting pole 1 is gradually sharpened. The structural arrangement of the mounting pole 1 allows the present application to be easily inserted into the ground of gardens and is easy to install. The first embodiment can be mounted on walls and surfaces, while the second embodiment can be mounted on the ground of gardens.

The foregoing descriptions are merely preferred embodiments of the present application and are not intended to limit the present application. Any modification, equivalent replacement and improvement made within the spirit and principle of the present application shall be included in the scope of protection of the present application.

What is claimed is:

1. A garden light with flame effect, wherein the garden light comprises a light body mounted on a mounting pole or a mounting board; the light body comprises a printed circuit board (PCB), a base body mounted with a plurality of SMD (surface-mount device) LED lights, a lampshade, and a hollow case; the base body has a cylindrical structure; the plurality of SMD LED lights are distributed on an outer peripheral surface of the base body and connected to the PCB; a lower end of the base body is fully covered with the SMD LED lights while the SMD LED lights on an upper end of the base body have a wave-shaped distribution; the lampshade has a cylindrical structure encasing the base body; and the hollow case encases the lampshade.

2. The garden light of claim 1, wherein the PCB is mounted on top of the base body; and an upper surface of the light body is provided with a control button connected to the PCB.

3. The garden light of claim 1, wherein first hollow flame-shaped openings are symmetrically provided on the hollow case; and second horizontal strip-shaped hollow openings are provided on both sides of the first hollow openings.

4. The garden light of claim 1, wherein an outer surface of the hollow case is an arc-shaped curved surface.

5. The garden light of claim 1, wherein the light body is located above the mounting pole; a lower portion of the mounting pole is formed by interlacing two strip-shaped structural members; a cross-section of the lower portion of the mounting pole is cross-shaped; and a bottom of the mounting pole is gradually sharpened.

6. The garden light of claim 1, wherein the light body is located above the mounting board; the mounting board comprises a lateral support plate and a vertical support plate that are fixed together; the lateral support plate is fixed under the light body; and the vertical support plate is mountable to a wall.

* * * * *